US005839364A

United States Patent [19]

Niemiro et al.

[11] Patent Number: 5,839,364

[45] Date of Patent: Nov. 24, 1998

[54] DAMPENING SYSTEM FOR A PRINTING PRESS

[75] Inventors: Thaddeus A. Niemiro, Lisle; Thomas W. Orzechowski, Cicero, both of Ill.

[73] Assignee: Goss Graphic Systems, Inc., Westmont, Ill.

[21] Appl. No.: 308,186

[22] Filed: Sep. 19, 1994

[51] Int. Cl.[6] ..... B41F 7/30; B41F 7/26

[52] U.S. Cl. ..... 101/148

[58] Field of Search ..... 101/147, 148, 101/388; 417/543; 138/30

[56] References Cited

U.S. PATENT DOCUMENTS

| | | | |
|---|---|---|---|
| 1,893,685 | 1/1933 | Pirsch | 417/543 |
| 4,050,378 | 9/1977 | Smith, Jr. | 101/147 |
| 4,445,829 | 5/1984 | Miller | 417/453 |
| 4,570,538 | 2/1986 | Webb | 101/148 |
| 5,337,791 | 8/1994 | Plager et al. | 138/30 |

*Primary Examiner*—J. Reed Fisher

*Attorney, Agent, or Firm*—Marshall, O'Toole, Gerstein, Murray & Borun

[57] ABSTRACT

A dampening assembly (10) for a printing press (12) having a spray bar (16) and source (18) of a liquid (L). The system (10) has a pressure regulator (22) being connected to the source (18) through a first conduit (20), and being connected to the spray bar (16) through a second conduit (24). The system (10) has an accumulator (26) having a chamber (28) being separated into first and second compartments (32 and 34), with the first compartment (32) being closed and being charged with an inert gas (G), and the second compartment (34) being connected to the second conduit (24). The system 10 has a third conduit (38) being connected between the second conduit (24) and the supply (18), and having a flow restriction orifice (40) restricting the flow of liquid (L) between the second conduit (24) and the source (18).

5 Claims, 1 Drawing Sheet

DAMPENING SYSTEM FOR A PRINTING PRESS

BACKGROUND OF THE INVENTION

The present invention relates to dampening systems for a printing press.

In the past, a liquid, such as water, has been supplied to a spray bar for wetting a dampening roller in the press for use in conjunction with ink for printing an image on a web. However, when the spray bar is turned off, a pressure gauge associated with the dampening system shows a maximum pressure the same as the source of water. In addition, the constantly changing pressure pulses caused by the on/off cycling of spray bar nozzle valve operators causes undesirable deterioration to the spray bar angle, thereby limiting formation of uniform fluid distribution along the length of the target surface.

SUMMARY OF THE INVENTION

A principal feature of the present invention is the provision of an improved dampening system for a printing press.

The dampening system of the present invention comprises, a spray bar for spraying a liquid on a roller of the press, a source of the liquid, a pressure regulator being connected to the source through a first conduit, and being connected to the spray bar through a second conduit, an accumulator having a chamber, and a third conduit being connected between the second conduit and the source.

A feature of the invention is that the chamber of the accumulator is separated by a flexible diaphragm into a first compartment communicating with the second conduit, and a second closed compartment being charged with an inert gas.

Another feature of the invention is that the accumulator dampens and smooths out the pulsations of liquid supplied to the spray bar.

Yet another feature of the invention is that a more even distribution of the liquid supplied to the spray bar is obtained with use of the accumulator.

A further feature of the invention is the provision of a flow restriction orifice in the third conduit.

Another feature of the invention is that a selected pressure is maintained in the second conduit less than the source pressure when the spray bar is turned off due to the feed back of liquid to the source.

Further features will become more fully apparent in the following description of the embodiments of the invention and from the appended claims.

DESCRIPTION OF THE PREFERRED EMBODIMENTS

Figure 1:
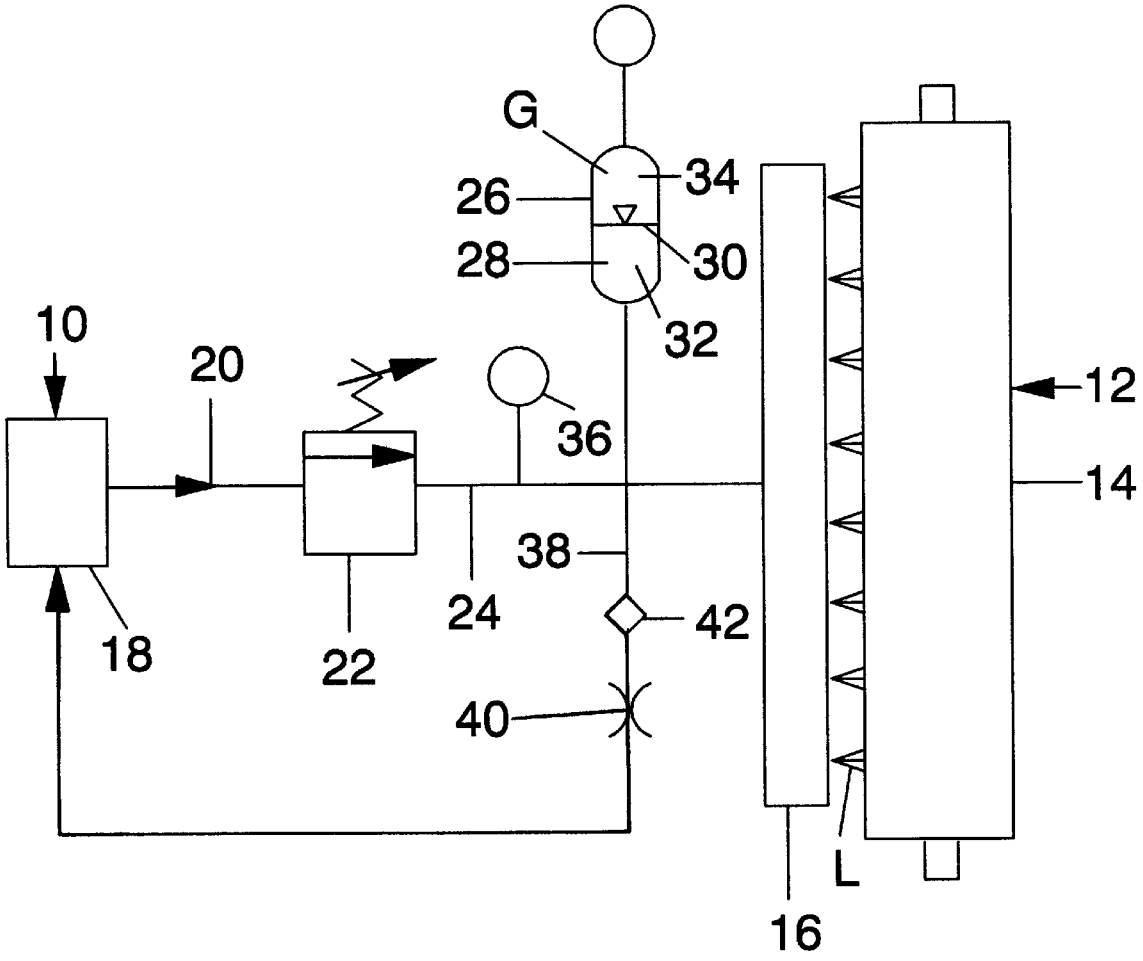
FIG. 1 is a diagrammatic view of a dampening system for a printing press.

Referring now ton FIG. 1, there is shown a dampening system or assembly generally designated 10 for a printing press generally designated 12 having a rotatable dampening roller 14. The system 10 has a spray bar 16 for spraying the dampening roller 14 with a liquid L, such as water, during operation of the press for use by the press 12 in conjunction with ink for printing a web.

The system 10 has a source or supply 18 of the liquid L which is connected by a first conduit 20 having a lumen or passageway to a pressure regulator 22 which maintains pressure in the system 10 at a selected pressure. The regulator 22 is connected by a second conduit 24 having a lumen to the spray bar 16 in order to supply the liquid L from the source 18 to the spray bar 16 and spray the liquid L onto the dampening roller 14.

The system 10 has an accumulator 26 having a chamber 28 which is separated by a flexible elastic diaphragm 30 into a first compartment 32 which communicates with the second conduit 24, and a second closed compartment 34 which is charged by an inert gas G, such as air.

In use, the pre-pressurized accumulator 26 compensates for the constantly changing pressure pulses created by the on/off cycling of spray bar nozzle valve operators. If not compensated by the rebound action of the accumulator 26, the pulses cause undesirable deterioration to the spray bar pattern angle, thereby limiting uniform fluid distribution along the length of the target surface. The action of the flexing diaphragm in the accumulator 26 improves the response time of the operation of the nozzle valves which is critical to the development of the desired spray angle, such that the accumulator smooths out the pulsations of liquid L, and obtains a more uniform distribution of the liquid L to the spray bar 16.

The system 10 also has a pressure gauge 36 to determine the pressure in the second conduit 24, and a third conduit 38 having a lumen connecting the second conduit 24 to the source of liquid 18 on an auxiliary or feed-back path. The third conduit 38 has a flow restriction orifice 40 restricting the passage of fluid from the second conduit 24 to the source 18. The third conduit 38 may also have a filter 42, if desired.

The third conduit 38 and orifice 40 act as a feed-back path from the second conduit 24 to the source 18 in order to maintain the selected pressure in the second conduit 24 less than the source pressure when the spray bar 16 or press is turned off. Without the feed-back conduit, the second conduit 24 would assume the maximum source pressure when the spray bar 16 was turned off, or the press is shut down. Thus, the feed-back path permits the operator to always determine the accurate pressure of the system 10 as indicated by the pressure gauge 36.

The foregoing detailed description is given for clearness of understanding only, and no unnecessary limitations should be understood therefrom, as modifications will be obvious to those skilled in the art.

We claim:

1. A dampening assembly for a printing press, comprising:

a spray bar for spraying a liquid onto a portion of the press;

a source of the liquid;

a pressure regulator being connected to the source by a first conduit, and being connected to the spray bar by a second conduit;

an accumulator having a chamber communicating with the second conduit, and having a diaphragm separating the chamber into a first compartment being connected to the second conduit, and a second closed compartment being charged with an inert gas, said accumulator dampening pressure pulses of the liquid being supplied to the spray bar.

2. The assembly of claim 1 including a third feedback conduit being connected between the second conduit and the source, said third conduit having a flow restriction orifice restricting the flow of liquid between the second conduit and the source.

3. The assembly of claim 1 including a pressure gauge communicating with the second conduit.

4. A dampening assembly for a printing press, comprising:

a spray bar for spraying a liquid on a portion of the press;

a source of the liquid;

a pressure regulator being connected to the source through a first conduit, and being connected to the spray bar through a second conduit;

an accumulator having a chamber being separated into first and second compartments by a diaphragm, with the first compartment being closed and being charged with an inert gas, and the second compartment being connected to the second conduit; and a third conduit being connected between the second conduit and the source and having a restriction orifice restricting the flow of liquid between the second conduit and the source.

5. The assembly of claim 4 including a pressure gauge connected to the second conduit.

* * * * *

UNITED STATES PATENT AND TRADEMARK OFFICE

CERTIFICATE OF CORRECTION

PATENT NO. : 5,839,364
DATED : November 24, 1998
INVENTOR(S) : Niemiro et al.

It is certified that error appears in the above-identified patent and that said Letters Patent is hereby corrected as shown below:

Column 1,
Line 24, please delete "comprises, a" and insert in its place -- comprises a --.
Line 45, please delete "feed back" and insert in its place -- feedback --.
Line 59, please delete "ton" and insert in its place -- to --.

Signed and Sealed this

Eighteenth Day of December, 2001

*Attest:*

*Attesting Officer*

JAMES E. ROGAN
*Director of the United States Patent and Trademark Office*